US005368267A

United States Patent [19]

Howard

[11] Patent Number: 5,368,267

[45] Date of Patent: Nov. 29, 1994

[54] NO-SAG FLOWERBOX BRACKETS

[76] Inventor: Check Howard, 201 Ocean Ave. 902B, Santa Monica, Calif. 90402

[21] Appl. No.: 59,224

[22] Filed: May 10, 1993

[51] Int. Cl.[5] ..... E04G 5/06

[52] U.S. Cl. ..... 248/231.4; 47/40; 248/278; 248/208; 248/276; 248/313

[58] Field of Search ..... 248/231.4, 235, 309.1, 248/313, 27.8, 208, 236, 304, 215, 214, 276; 108/47, 42; 47/40, 67

[56] References Cited

U.S. PATENT DOCUMENTS

| | | | |
|---|---|---|---|
| 964,305 | 7/1910 | Newgarden | 248/208 |
| 2,266,294 | 12/1941 | Allderdice | 248/311.2 |
| 2,673,057 | 3/1954 | Morris, Sr. | 248/311.2 |
| 2,726,837 | 12/1955 | Jameson | 248/231.7 |
| 2,749,072 | 6/1956 | Long | 248/214 |
| 3,094,304 | 6/1963 | Linder, Jr. | 248/211 |
| 3,502,294 | 3/1970 | Kalbow et al. | 248/311.2 |
| 3,870,212 | 3/1975 | Polk | 225/42 |
| 4,071,976 | 2/1978 | Chernewski | 47/67 X |
| 4,422,610 | 12/1983 | Hunt | 248/311.2 |
| 4,896,456 | 1/1990 | Grant | 47/67 |
| 4,949,924 | 8/1990 | Carmody | 248/215 |
| 4,958,594 | 9/1990 | Swagerty | 119/7 |
| 5,118,059 | 6/1992 | Mainer | 47/67 X |

*Primary Examiner*—Ramon O. Ramirez
*Attorney, Agent, or Firm*—Cislo & Thomas

[57] ABSTRACT

A flowerbox support bracketing comprising a plurality of similar L-shaped members and a generally Z-shaped member. The L-shaped members each have a first arm and a second arm, each arm formed with elongated longitudinal slots. The generally Z-shaped member comprises a vertical arm and horizontal top and bottom arms, the horizontal arms being directed in opposite directions and the top arm defining an aperture to receive a bolt wherein a wing nut is threadedly engaged. By overlapping the first and second arms of the L-shaped member with the top arm of the Z-shaped member a flowerbox is clamped to a wall or the like by the descending of one L-shaped arm into the flowerbox's interior and the other L-shaped arm descending over the back of the wall for engagement thereto.

8 Claims, 1 Drawing Sheet

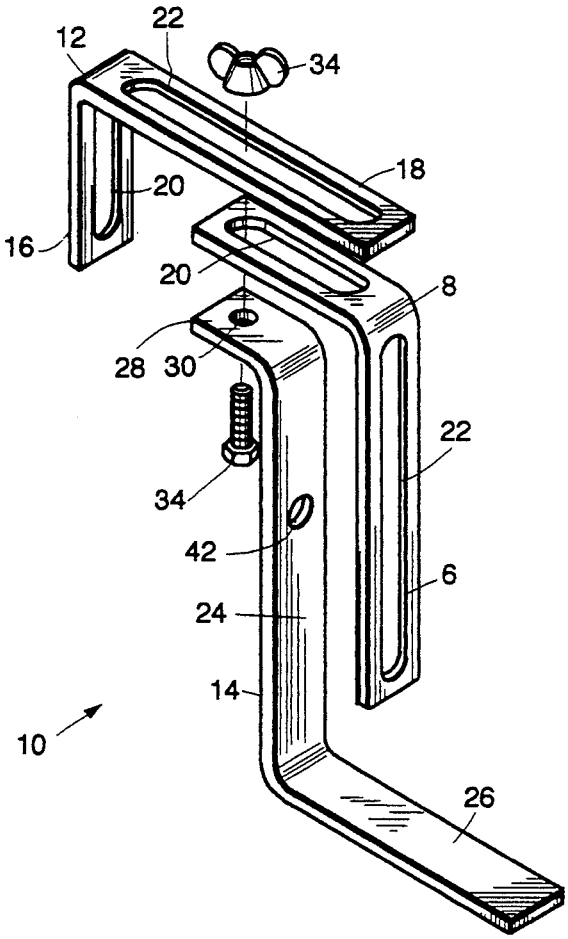
FIG. 1.
FIG. 2.
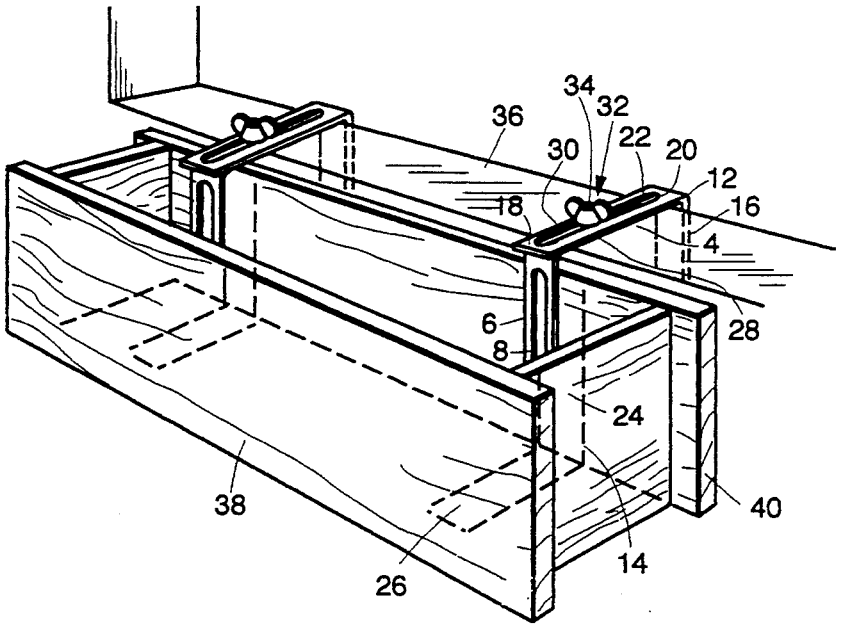

NO-SAG FLOWERBOX BRACKETS

BACKGROUND OF THE INVENTION

This invention relates generally to the field of support structures and is specifically directed to an adjustable structure securable to railings, fences, walls and the like for mounting conventional flowerboxes of varying sizes.

The use of flowerboxes to display plants and flowers has enjoyed renewed popularity in recent years, particularly with the increase in cities of the numbers of townhouse, condominium, and apartment dwellers, who frequently have no yard for flowers or plants to be placed in. Furthermore, individuals having yards or similar facilities increasingly make use of flowerboxes for decorative purposes. Although flowerboxes are still placed on horizontal support surfaces, it has become increasingly popular to elevate the flowerboxes by various mounting and suspension devices onto railings or walls to enhance the beauty of patios, backyards and the like.

Numerous types of support brackets are commercially available for mounting flowerboxes and the like. Generally, such support brackets are attached to either the flowerbox or the vertical support structure or both. A disadvantage associated with support brackets being mounted or attached to the flowerbox is that over the course of time the flowerbox tends to accumulate moisture resulting in added weight wherein the flowerbox begins to sag.

Additional disadvantages associated with support brackets are, for example, the number of vertical support structures that they can be attached to. Typically, a support bracket designed principally to be mounted on railings is unacceptable for use with fences or walls. Also, support brackets do not provide means for securing the brackets to different sizes of a vertical support structure so that the brackets are not easily dislodged.

Because of the continued widespread use of flowerboxes, it is desirable to have a support bracketing capable of rigidly supporting the relatively heavy flowerbox and its contents, and which also is capable of being adjustable to engage flowerboxes and vertical support structures of varying sizes without having to be permanently affixed to either the flowerbox or to the vertical support structure.

The subject invention herein solves all of these problems in a new and unique manner which has not been part of the art previously. Some related patents are described below:

U.S. Pat. No. 3,870,212 issued to I. H. Polk on Mar. 11, 1975

This patent is directed to a support holder for dispensing foil. The package containing the dispensing foil is supported by the bottom of a trough-like bracket structure, and maintained in position by virtue of adjustably positioned angle brackets. These angle brackets are provided with slotted through openings for adjustably clamping the brackets against the package, as opposed to clamping an interior wall thereof, and are secured in place by the use of winged nuts.

U.S. Pat. No. 2,266,294 issued to H. E. Allerdice on Dec. 16, 1941

This patent is directed to a wall bracket for supporting a flower pot. The wall bracket consists of an anchor unit having a substantially U-shaped contour wherein the end is adjusted for extension within the flower pot to provide support therefor, such support being in addition to a bottom support.

U.S. Pat. No. 2,673,057 issued to H. C. Morris on Mar. 23, 1954

This patent is directed to a detachable holder for supporting a bait container. The detachable holder is provided with a Z-shaped bracket having a horizontal arm for extension over a railing or support surface. The arm is formed with a slotted through opening through which is coupled an angle bracket for providing clamping engagement with the support structure. Further, the support elements are provided with slotted openings to clampingly engage the object being supported thereby.

U.S. Pat. No. 2,749,072 issued to J. J. Long on Jun. 5, 1956

This patent is directed to an attachment bracket for supporting decorative articles to a Venetian blind. The attachment bracket consists of a bottom support or shelf and a hook which is slidably mounted on an interconnection member, the interconnection member in turn being secured to a plurality of securing brackets which are affixed to the slats of the Venetian blind. The interconnection member is vertically adjustable by being made in two telescopically arranged sections.

U.S. Pat. No. 4,9584,594 issued to B. H. Swagerty on Sep. 25, 1990

This patent is directed to a hangar assembly for supporting articles therefrom. The hangar assembly consists of an elongated vertical member secured to a wall by means of L-shaped receiving clips by virtue of adjustable coupling between a horizontal leg and a horizontal plate of the vertical member, whereby a pair of threaded fasteners extending through an elongated slotted opening formed in the horizontal leg may be tightened. Thus, the structure provides clamping engagement with the wall. The hangar assembly is preferably associated with a horse trailer or horse stall.

SUMMARY OF THE INVENTION

A support bracketing for mounting on walls, fences, railings and the like as set forth in the present invention comprises a pair of generally L-shaped members and a generally Z-shaped member. The L-shaped members each have a first arm and a second arm, each arm formed with elongated longitudinal slots. Depending on the application, the length of the first arm may vary from between 20 to 50 percent the length of the second arm. The generally Z-shaped member comprises a vertical arm and horizontal top and bottom arms, the horizontal arms being directed in opposite directions with the top arm defining an aperture to receive a bolt.

In application two or more support bracketings may be used to support a flowerbox depending on its overall weight. For purposes of describing the support bracketing embodiment of the present invention only one support bracketing will be considered. Henceforth, the Z-shaped member is placed such that its top arm extends over and rests on the horizontal portion of a wall with a bolt protruding upward and through the top arm aperture wherein the vertical arm is located against the front vertical portion of the wall. The bottom of the flowerbox is then placed on top of the horizontal bottom arm with the rearward side of the flowerbox placed flush against the Z-shaped member's vertical arm. The length of the Z-shaped member's bottom arm may vary from between 10 to 100 percent the bottom width of the flowerbox.

The second arm of one of the L-shaped members is then placed downward and vertically against the front interior of the flowerbox's rearward side such that the first arm locates flush against and overlaps the Z-shaped member's top arm with the bolt protruding upward and through the elongated longitudinal slot. The first arm of the other L-shaped member is then placed downward and vertically against the back vertical portion of the wall such that its second arm locates flush against and overlaps the other L-shaped member's first arm with the bolt similarly protruding upward and through the elongated longitudinal slot.

Both L-shaped members and the Z-shaped member are now overlapped and coplanar with respect to each other and engaged by the bolt through the aperture and slots, a wing nut being threaded onto the bolt to screwedly engage the overlapped members together. Thus each L-shaped member can slide forward or backward to clampingly engage the flowerbox against the vertical portion of the wall before the wing nut is tightened down for final engagement. In this manner, the width dimension of the wall can be adjusted for as well as the thickness of the rearward side of the flowerbox. This adjustment provides a relatively tight fit to inhibit the dislocation or movement of the flowerbox.

The support bracketing of the present invention operates to prevent sagging due to the compression force between the first and second arm of the L-shaped members clampingly engaging the flowerbox in combination with the vertical and bottom arms of the Z-shaped member providing for a greater range of contact area throughout the flowerbox structure. This greater range of contact area by the L and Z-shaped members translates into higher support strength than is typically produced by bolting the flowerbox to a wall which provides for only a small localized area of support. Therefore the combination of L-shaped and Z-shaped members achieves a greater offloading capability then support or mounting devices that attach at a single point thereby preventing the flowerbox from sagging.

Accordingly, it is an object of the present invention to provide an improved flowerbox support bracketing which is inexpensive to manufacture, which is sturdy in construction, and which is easy to set up for use. A further object of the invention is to adjustably receive various sizes of flowerboxes and to be engaged on various types of supporting structures without damaging either the support structure or flowerbox.

BRIEF DESCRIPTION OF THE DRAWINGS

The above, as well as other, advantages of the present invention will become readily apparent to those skilled in the art from the following detailed description of the preferred embodiments when considered in the light of the accompanying drawings in which:

FIG. 1 is an exploded view of the support bracketing of the present invention.

FIG. 2 is a perspective view of the support bracketing and flowerbox in a final mounted condition.

DESCRIPTION OF THE PREFERRED EMBODIMENTS

Referring now to the drawings wherein like reference numerals refer to like and corresponding parts throughout, the support bracketing is generally indicated by numeral 10. Referring now to FIG. 1, the support bracketing 10 which is particularly adapted for mounting on walls, fences, railings and the like comprises generally a pair of L-shaped members 8 and 12 and an associated Z-shaped member 14.

Each of the L-shaped members 8 and 12 are essentially identical and the following description will generally be applicable to both. As seen in FIG. 1, a first L-shaped member 12 consists of a first arm 16 formed with an elongated longitudinal slot 20 and a second arm 18 formed with an elongated longitudinal slot 22. Similarly, a second L-shaped member 8 consists of a first arm 4 formed with an elongated longitudinal slot 20 and a second arm 6 formed with an elongated longitudinal slot 22. The length of first arms 4 and 16 are generally less in length and may vary from 20 to 50 percent the length of second arms 6 and 18.

The generally Z-shaped member 14 has a vertical arm 24 greater in length then second arms 6 and 18. The Z-shaped member further comprises a horizontal arm 26 at its bottom end and a horizontal arm 28 at its top end, the arms 26 and 28 being directed in opposite directions. The top arm 28 defines an aperture 30 to receive a bolt 32 on which a wing nut 34 is threadingly engaged.

Referring now to FIG. 2, the top arm 28 of Z-shaped member 14 extends over and rests on the horizontal portion of wall 36 with bolt 32 protruding upward and through aperture 30. The bottom of flowerbox 38 is located on top of horizontal bottom arm 26 with the rearward side 40 of flowerbox 38 placed against vertical arm 24 wherein both are located flush against the front vertical portion of wall 38. The length of bottom arm 26 may vary from between 10 to 100 percent the bottom width of flowerbox 38.

The second arm 6 of second L-shaped member 8 is located downward and vertically against the rearward front interior of flowerbox 38 with first arm 4 flush against and overlapping top arm 28. The first arm 16 of first L-shaped member 12 is located downward and vertically against the back vertical portion of wall 36 with second arm 18 flush against and overlapping first arm 4 of second L-shaped member 8 wherein bolt 32 protrudes upward and through both elongated longitudinal slots 20 and 22.

The overlapped arms 4 and 18 of L-shaped members 8 and 12 slide forward or backward against each other to clampingly engage flowerbox 38 against the vertical portion of wall 36 before wing nut 34 is tightened down on bolt 32 for final engagement and securement thereto. Additionally, the overlapped arms 4 and 18 are adjustable for the width dimension of wall 36 as well as the thickness of the rearward side 40 of flowerbox 38. This adjustment capability is provided by elongated slots 20 and 22.

It will be understood that L-shaped members 8 and 12 may be interchanged and still perform the same function as described above with first arms 4 and 16 and second arms 6 and 18 having various lengths. Further, the requirement of using elongated slots as an adjustment means in both L-shaped members 8 and 12 is not necessary and the invention could be embodied in custom designed units intended for a use or applications with particular walls and particular flowerboxes.

The support bracketing 10 according to the present invention can be formed out of a metal alloy such as aluminum or steel which can then be anodized, stained or painted for protection against exposure to different environmental conditions, thereby preventing the support bracketing 10 from rusting. Additionally, the support bracketing 10 can be made of a plastic material for light weight applications by any known manufacturing method such as extrusion.

While not shown in the drawings, it can also be envisioned that when the support bracketing 10 is not in use, it may be folded to a nested position with the first arms 6 and 18 of L-shaped members 8 and 12 nested against each other and against vertical arm 24 of Z-shaped member 14, all of which are fastened together by using bolt 32 and wing nut 34 through packaging aperture 42 shown in FIG. 1.

The foregoing description and drawings will suggest other embodiments and variations within the scope of the claims to those skilled in the art, all of which are intended to be included in the spirit of the invention as herein set forth.

What is claimed is:

1. A support bracketing for supporting flowerboxes and the like to a vertical support structure comprising:

first and second L-shaped members each having a first arm and a second arm, said first and second arms each having an elongated longitudinal slot therein;

a Z-shaped member having a vertical arm and top and bottom horizontal arms, said top horizontal arm extending in a direction opposite to said bottom horizontal arm, said top horizontal arm having an aperture therein;

wherein said first and second arms of said L-shaped members overlap with said top horizontal arm of said Z-shaped member along a horizontal portion of the vertical support structure, a bolt extending through said aperture of said Z-shaped member and said slots of said first and second arms of said L-shaped members, a wing nut threadedly engaged on said bolt;

whereby the flowerbox is clamped to the vertical support structure by the descending of said first L-shaped member arm into the flowerbox's interior and said second L-shaped member arm descending over the back of the vertical support structure for engagement of the rearside of the flowerbox to the vertical portion of the vertical support structure, the bottom of the flowerbox lying along said horizontal bottom arm.

2. A support bracket according to claim 1, wherein the length of said first arm of said first and second L-shaped members may be between 20 to 50 percent the length of said second arm of said first and second L-shaped members.

3. A support bracketing according to claim 1, wherein said L-shaped and said Z-shaped members may be formed out of a metal alloy.

4. A support bracketing according to claim 1, wherein said L-shaped and said Z-shaped members may be formed out of steel or aluminum which can be anodized, stained or painted for protection against exposure to the environment.

5. A support bracketing according to claim 1, wherein said L-shaped and said Z-shaped members may be made of a plastic material.

6. A support bracketing according to claim 1, wherein said L-shaped and said Z-shaped members may be made of a plastic material for light weight applications by a method of extrusion.

7. A support bracket according to claim 1, wherein the length of said bottom horizontal arm of said Z-shaped member may vary from between 10 to 100 percent the bottom width of the flowerbox.

8. A support bracketing for supporting flowerboxes and the like to a vertical support structure comprising:

first and second L-shaped members each having a first arm and a second arm, said first and second arms each having an elongated longitudinal slot therein and the length of said first arm of said first and second L-shaped members may be between 20 to 50 percent the length of said second arm of said first and second L-shaped members;

a Z-shaped member having a vertical arm and top and bottom horizontal arms, said top horizontal arm extending in a direction opposite to said bottom horizontal arm, said top horizontal arm having an aperture therein and the length of said bottom horizontal arm of said Z-shaped member may vary from between 10 to 100 percent the bottom width of the flowerbox;

said L-shaped and said Z-shaped members may be formed out of a metal alloy such as steel or aluminum which can be anodized, stained or painted for protection against exposure to the environment or may be made of a plastic material for light weight applications by any known method such as extrusion;

wherein said first and second arms of said L-shaped members overlap with said top horizontal arm of said Z-shaped member along a horizontal portion of the vertical support structure, a bolt extending through said aperture of said Z-shaped member and said slots of said first and second arms of said L-shaped members, a wing nut threadedly engaged on said bolt;

whereby the flowerbox is clamped to the vertical support structure by the descending of said first L-shaped member arm into the flowerbox's interior and said second L-shaped member arm descending over the back of the vertical support structure for engagement of the rearside of the flowerbox to the vertical portion of the vertical support structure, the bottom of the flowerbox lying along said horizontal bottom arm.

* * * * *